US008459366B2

(12) United States Patent
Sevre

(10) Patent No.: US 8,459,366 B2
(45) Date of Patent: Jun. 11, 2013

(54) TEMPERATURE DEPENDENT SWELLING OF A SWELLABLE MATERIAL

(75) Inventor: Alf K. Sevre, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 316 days.

(21) Appl. No.: 13/043,030

(22) Filed: Mar. 8, 2011

(65) Prior Publication Data

US 2012/0227986 A1 Sep. 13, 2012

(51) Int. Cl.
*E21B 33/12* (2006.01)

(52) U.S. Cl.
USPC ..... 166/387; 166/118

(58) Field of Classification Search
USPC ..... 166/387, 118, 187
See application file for complete search history.

(56) References Cited

U.S. PATENT DOCUMENTS

| | | | | |
|---|---|---|---|---|
| 1,502,372 | A | 7/1924 | Callanan, Jr. | |
| 2,002,122 | A | 5/1935 | McWane | |
| 2,144,026 | A | 1/1939 | Park | |
| 2,849,070 | A | 8/1958 | Maly | |
| 2,945,541 | A | 7/1960 | Maly et al. | |
| 3,026,223 | A | 3/1962 | Vanderbilt et al. | |
| 3,099,318 | A | 7/1963 | Miller et al. | |
| 3,158,210 | A | 11/1964 | Cannon et al. | |
| 3,195,907 | A | 7/1965 | Eckenrod | |
| 3,385,367 | A * | 5/1968 | Kollsman | 166/191 |
| 3,916,999 | A | 11/1975 | Ellis et al. | |
| 3,918,523 | A * | 11/1975 | Stuber | 166/285 |
| 4,137,970 | A | 2/1979 | Laflin et al. | |
| 4,182,677 | A | 1/1980 | Bocard et al. | |
| 4,240,800 | A | 12/1980 | Fischer | |
| 4,558,875 | A | 12/1985 | Yamaji et al. | |
| 4,633,950 | A | 1/1987 | Delhommer et al. | |
| 4,635,726 | A | 1/1987 | Walker | |
| 4,862,967 | A | 9/1989 | Harris | |

(Continued)

FOREIGN PATENT DOCUMENTS

| | | | |
|---|---|---|---|
| JP | 4-363499 | A | 12/1992 |
| JP | 09-151686 | A | 6/1997 |
| JP | 2000-064764 | A | 2/2000 |
| WO | 2010017208 | A2 | 2/2010 |

OTHER PUBLICATIONS

International Search Report and Written Opinion issued Dec. 3, 2012 for PCT Application No. PCT/US12/26642,12 pages.
International Search Report issued Nov. 13, 2001, for International Patent Application Serial No. PCT/NO01/00275, 3 pages.
European Patent Office Communication of a Notice of Opposition issued Dec. 14, 2007, for European Patent Application Serial No. 01958642.9, 16 pages.

(Continued)

*Primary Examiner* — David Bagnell
*Assistant Examiner* — Blake Michener
(74) *Attorney, Agent, or Firm* — Smith IP Services, P.C.

(57) ABSTRACT

A swellable packer can include a material which swells when contacted with a swelling fluid, and a barrier comprising a highly crystalline polymer which is substantially impermeable to the swelling fluid. A method of controlling swelling of a material can include positioning the material and a barrier in a well, the barrier preventing contact between the material and a swelling fluid, the barrier comprising a polymer, and increasing a permeability of the barrier to the swelling fluid in response to the barrier polymer being heated to its crystallization temperature. A well system can include a material which swells in response to contact with a hydrocarbon gas, and a barrier which comprises a crystalline polymer, the polymer being substantially impermeable to the hydrocarbon gas, whereby the polymer initially prevents swelling of the material, but the polymer becomes increasingly permeable to the hydrocarbon gas when heated to its crystallization temperature.

20 Claims, 3 Drawing Sheets

U.S. PATENT DOCUMENTS

| | | | | |
|---|---|---|---|---|
| 4,919,989 | A | 4/1990 | Colangelo | |
| 5,180,704 | A | 1/1993 | Reindl et al. | |
| 5,195,583 | A | 3/1993 | Toon et al. | |
| 5,523,357 | A | 6/1996 | Peterson | |
| 6,834,725 | B2 | 12/2004 | Whanger et al. | |
| 6,848,505 | B2 | 2/2005 | Richard et al. | |
| 6,935,432 | B2 | 8/2005 | Nguyen | |
| 7,059,415 | B2 * | 6/2006 | Bosma et al. | 166/313 |
| 7,143,832 | B2 * | 12/2006 | Freyer | 166/387 |
| 7,228,915 | B2 | 6/2007 | Thomson | |
| 7,431,098 | B2 * | 10/2008 | Ohmer et al. | 166/387 |
| 7,472,757 | B2 | 1/2009 | Freyer | |
| 7,832,491 | B2 | 11/2010 | Freyer | |
| 8,051,914 | B2 | 11/2011 | Freyer | |
| 8,191,644 | B2 * | 6/2012 | Rytlewski et al. | 166/387 |
| 2004/0020662 | A1 * | 2/2004 | Freyer | 166/387 |
| 2004/0194971 | A1 | 10/2004 | Thomson | |
| 2005/0199401 | A1 | 9/2005 | Patel et al. | |
| 2006/0272806 | A1 | 12/2006 | Wilkie et al. | |
| 2007/0151723 | A1 * | 7/2007 | Freyer | 166/179 |
| 2008/0149351 | A1 * | 6/2008 | Marya et al. | 166/387 |
| 2009/0120640 | A1 * | 5/2009 | Kulakofsky et al. | 166/277 |
| 2009/0205816 | A1 * | 8/2009 | De et al. | 166/118 |
| 2009/0283254 | A1 * | 11/2009 | Andersen et al. | 166/118 |
| 2010/0025049 | A1 | 2/2010 | Korte et al. | |
| 2010/0096119 | A1 * | 4/2010 | Sevre et al. | 166/51 |
| 2010/0139929 | A1 * | 6/2010 | Rytlewski et al. | 166/387 |
| 2010/0163252 | A1 * | 7/2010 | Regnault De La Mothe et al. | 166/387 |
| 2010/0212891 | A1 * | 8/2010 | Stewart et al. | 166/250.12 |
| 2010/0236775 | A1 * | 9/2010 | Sevre et al. | 166/188 |
| 2010/0314134 | A1 | 12/2010 | Nutley et al. | |

OTHER PUBLICATIONS

Kirk-Othmer, Encyclopedia of Chemical Technology, 1993, vol. 6, title page, index page, and p. 70.

The Concise Oxford Dictionary, 7th ed., 1985, title page and pp. 148-149, 360-361 and 740-741.

EPO Communication issued Feb. 8, 2007: Letter from the Opponent dated Jan. 31, 2007, for European Patent Application Serial No. 01958642.9, 2 pages.

Halliburton Amendment dated Jul. 18, 2007, to EPO in response to Notice of Opposition to European Patent Application Serial No. 01958642.9, 15 pages.

EPO Communication issued Sep. 3, 2007: Letter from the Opponent dated Aug. 22, 2007, for European Patent Application Serial No. 01958642.9, 11 pages.

Office Action issued Jul. 6, 2007 for U.S. Appl. No. 11/551,143, 13 pages.

Office Action issued Mar. 1, 2010 for U.S. Appl. No. 12/323,237, 10 pages.

Office Action issued Nov. 5, 2010 for U.S. Appl. No. 12/847,609, 10 pages.

Office Action issued Apr. 15, 2011 for U.S. Appl. No. 12/847,609, 6 pages.

Office Action issued May 5, 2011 for U.S. Appl. No. 12/847,609, 8 pages.

Author Unknown, "Polymer Crystallinity", dated 2005, 8 pages.

Answers.com; "Differential Scanning Calorimetry", undated, 7 pages.

* cited by examiner

TEMPERATURE DEPENDENT SWELLING OF A SWELLABLE MATERIAL

BACKGROUND

This disclosure relates generally to equipment utilized and operations performed in conjunction with a subterranean well and, in an example described below, more particularly provides for temperature dependent swelling of a swellable material.

It would be advantageous to be able to delay or temporarily prevent swelling of a swellable material of the type used in subterranean wells. This would, for example, allow a swellable packer to be appropriately positioned in a well before the packer swells appreciably, allow an actuator to be actuated as desired, etc.

SUMMARY

In the disclosure below, a temperature dependent barrier is provided for a swellable material. One example is described below in which a barrier substantially prevents a swelling fluid from swelling a swellable material. Another example is described below in which a polymer of the barrier has a crystallization temperature, above which the barrier becomes increasingly permeable to the swelling fluid.

In one aspect, a swellable packer is provided by the disclosure below. The swellable packer can include a swellable material which swells when contacted with a swelling fluid, and a barrier comprising a relatively highly crystalline polymer which is substantially impermeable to the swelling fluid.

In another aspect, a method of controlling swelling of a swellable material in a well is provided. The method can include: positioning the swellable material and a barrier in the well, the barrier preventing contact between the swellable material and a swelling fluid in the well, the barrier comprising a polymer; and increasing a permeability of the barrier to the swelling fluid in response to the polymer being heated to a crystallization temperature of the polymer.

In yet another aspect, a well system described below can include a swellable material which swells in response to contact with a hydrocarbon gas or liquid, and a barrier which comprises a crystalline polymer. The polymer is substantially impermeable to the hydrocarbon gas or liquid, whereby the polymer initially prevents swelling of the swellable material, but the polymer becomes increasingly permeable to the hydrocarbon gas or liquid when heated to a crystallization temperature of the polymer.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
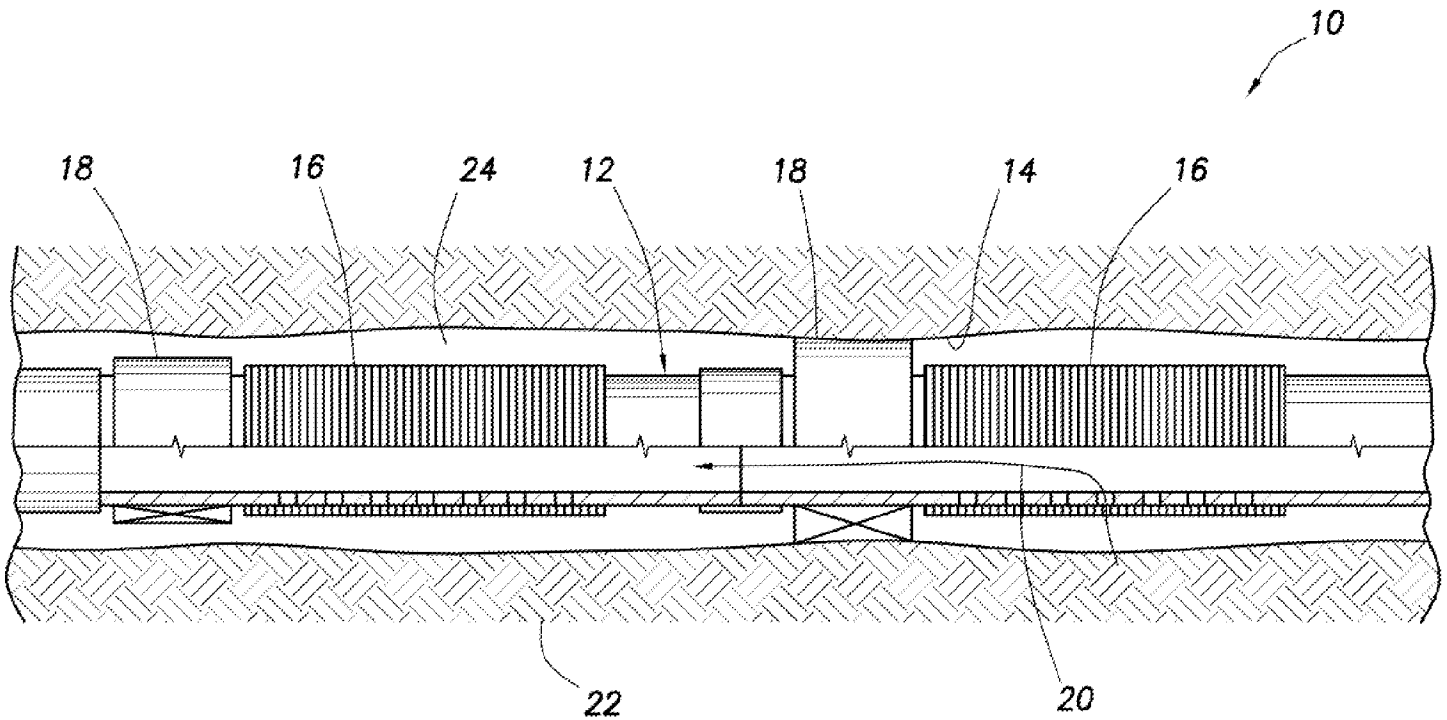
FIG. 1 is a representative partially cross-sectional view of a well system and associated method which can embody principles of the present disclosure.

Representatively illustrated in FIG. 1 is a well system 10 and associated method which can embody principles of this disclosure. In the system 10 as depicted in FIG. 1, a tubular string 12 (such as a completion string, a production tubing string, etc.) is positioned in a wellbore 14.

The tubular string 12 in this example includes well screens 16 and swellable packers 18. The well screens 16 are used to filter fluid 20 (e.g., oil, water, hydrocarbon gas, etc.) which flows from a formation 22 into the tubular string 12.

The swellable packers 18 are used to isolate sections of an annulus 24 formed radially between the tubular string 12 and the wellbore 14. In this manner, the fluid 20 can be produced from individual zones or intervals of the formation 22.

The wellbore 14 is depicted in FIG. 1 as being open hole or uncased, but in other examples the wellbore could be lined or cased. The fluid 20 is depicted in FIG. 1 as being produced from the formation 22 into the tubular string 12, but in other examples fluid could be injected into the formation, alternately injected and produced, injected into one zone and produced from another zone, etc.

Thus, it should be clearly understood that the well system 10 and method illustrated in FIG. 1 and described herein is merely one example of a wide variety of possible uses for the principles of this disclosure. Those principles are not limited at all to the details of the well system 10 and method depicted in FIG. 1 and described herein.

Note that one of the packers 18 is shown as forming an annular barrier between the tubular string 12 and the wellbore 14, and the other of the packers does not form such an annular barrier. This is due to one of the packers 18 being swollen, and the other of the packers not being swollen. Although, in actual practice, it may not be the case that one of the packers 18 is swollen while the other of the packers is not swollen, this situation is depicted in order that the difference between these configurations of the packers can be readily appreciated.

The term "swell" and similar terms (such as "swellable") are used herein to indicate an increase in volume of a swellable material. Typically, this increase in volume is due to incorporation of molecular components of an activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material is in this example preferably a hydrocarbon fluid (such as oil or gas). In the well system 10, the swellable material swells when the fluid comprises the activating agent (e.g., when the fluid enters the wellbore 14 from a formation surrounding the wellbore, when the fluid is circulated to the packers 18, when the fluid is released from a chamber carried with the packer assembly, etc.). In response, a seal element of each packer 18 seals off the annulus 24 and can apply a gripping force to the wellbore 14 (or a casing which lines the wellbore, etc.).

The activating agent which causes swelling of the swellable material could be comprised in any type of fluid. The activating agent could be naturally present in the well, or it could be conveyed with the packers 18, conveyed separately or flowed into contact with the swellable material in the well when desired. Any manner of contacting the activating agent with the swellable material may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material may have a substantial portion of cavities therein which are compressed or collapsed at surface conditions. Then, after being placed in the well at a higher pressure, the material swells by the cavities filling with fluid.

This type of apparatus and method might be used where it is desired to expand the swellable material in the presence of gas rather than oil or water. A suitable swellable material is described in U.S. Published Application No. 2007-0257405, the entire disclosure of which is incorporated herein by this reference.

Preferably, the swellable material used in the packers 18 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material could also swell in response to contact with any of multiple activating agents. For example, the swellable material could swell when contacted by hydrocarbon fluid and/or when contacted by water.

In the example of FIG. 1, the packers 18 swell in response to contact with a swelling fluid which comprises hydrocarbons. Unfortunately, while the tubular string 12 is being installed in the wellbore 14, it is possible for an influx of hydrocarbon fluid (e.g., oil, gas (in gaseous, condensate or liquid form), etc.) to be received into the wellbore.

For example, an inadvertent influx of gas into the wellbore 14 could come into contact with the packers 18 long before the tubular string 12 has been completely installed. This could cause the packers 18 to swell prematurely, making it extremely difficult or impossible to appropriately position the tubular string 12 in the wellbore 14.

Therefore, it will be appreciated that it would be beneficial to be able to delay initiation of swelling of the packers 18 until the tubular string 12 is at (or at least near) its desired position in the wellbore 14. Since temperature in the wellbore 14 generally increases with depth, a barrier could be used to prevent contact between the swelling fluid and the swellable material of the packers 18, until the temperature has increased to a predetermined level, at which point the barrier could permit contact between the swellable material and the swelling fluid.

Figure 2A:
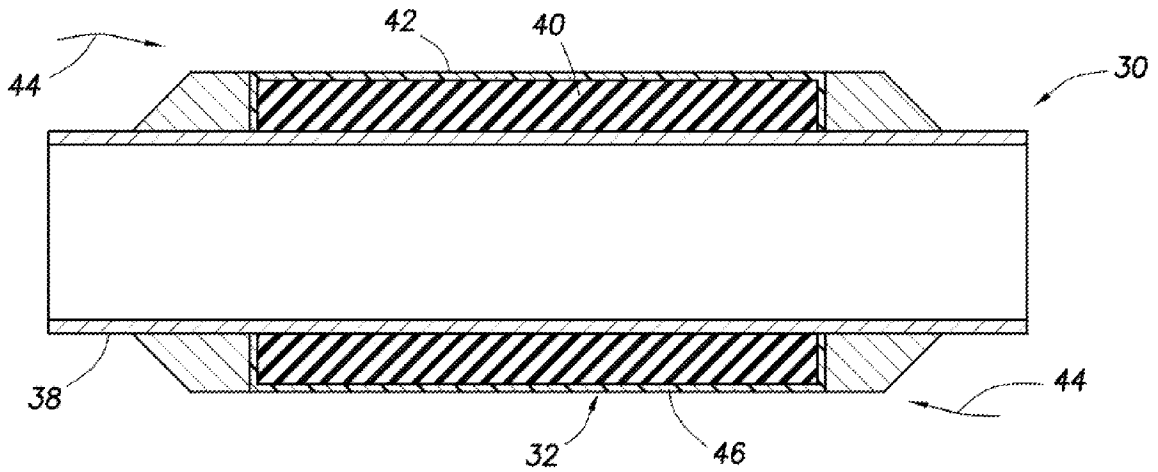
FIGS. 2A & B are representative cross-sectional views of a swellable packer which may be used in the well system and method of FIG. 1, the packer being not swollen in FIG. 2A and swollen in FIG. 2B.

Referring additionally now to FIGS. 2A & B, a swellable packer 30 which may be used for either or both of the swellable packers 18 in the well system 10 and method is representatively illustrated. Of course, the packer 30 could be used in other well systems and other methods, without departing from the principles of this disclosure.

Figure 2B:
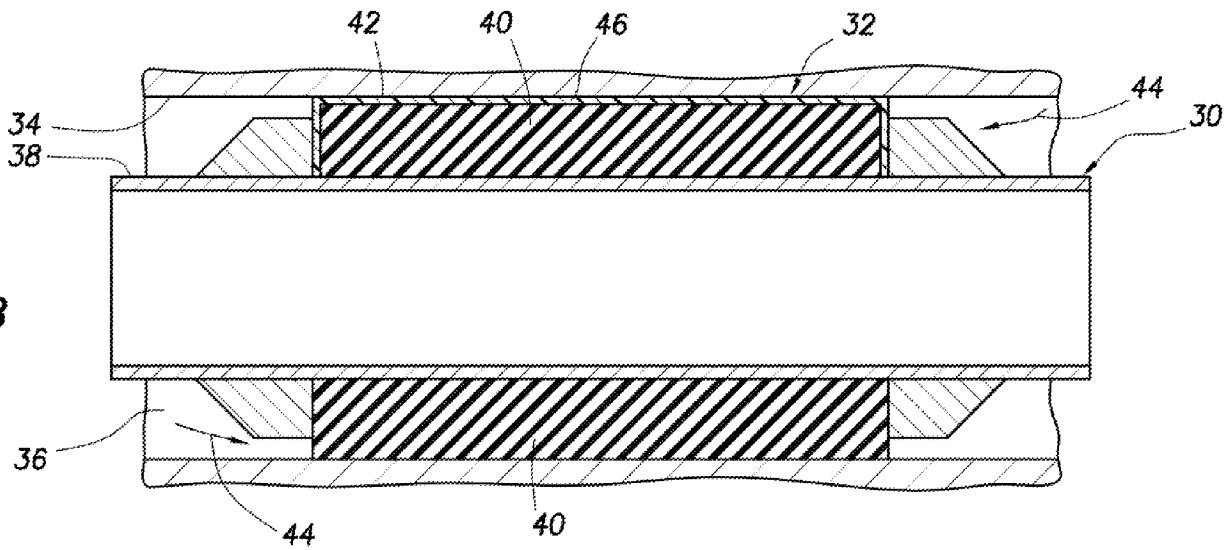

In FIG. 2A, the packer 30 is depicted in an un-swollen configuration, with a seal element 32 thereof being radially retracted. In FIG. 2B, the packer 30 is depicted in a swollen configuration, with the seal element 32 being radially outwardly extended into sealing contact with a well surface 34 (such as the wellbore 14, casing or liner lining the wellbore, etc.). The seal element 32 in FIG. 2B forms an annular barrier, thereby sealing off an annulus 36 formed radially between the well surface 34 and a base pipe 38 of the packer 30.

In FIG. 2A it may be seen that the seal element 32 comprises a swellable material 40 and a barrier 42. The barrier 42 prevents contact between the swellable material 40 and a swelling fluid 44.

In FIG. 2B, the barrier 42 permits contact between the swellable material 40 and the swelling fluid 44 when a predetermined temperature has been reached. This causes the swellable material 40 to swell, so that the seal element 32 extends radially outward into sealing contact with the surface 34. Such swelling of the material 40 could take any amount of time (e.g., seconds, minutes, hours, days, etc.).

An upper portion of FIG. 2B depicts the barrier 42 remaining on the swellable material 40 after it has swollen. A lower portion of FIG. 2B depicts the barrier 42 as being dispersed upon swelling of the material 40. This demonstrates that any disposition of the barrier 42 may occur when the material 40 swells, in keeping with the principles of this disclosure.

Preferably, the barrier 42 comprises a relatively highly crystalline polymer 46 which is substantially impermeable to the swelling fluid 44 at lower temperatures. However, at elevated temperatures, the polymer 46 becomes substantially permeable to the swelling fluid 44.

In one important feature of the packer 30 as depicted in FIGS. 2A & B, the barrier 42 becomes substantially permeable to the swelling fluid 44 when the barrier is heated to a crystallization temperature of the polymer 46. Crystallization temperatures of common polymers are well known in the art, and can be conveniently measured by techniques such as differential scanning calorimetry.

Polymers can be engineered, so that they have certain desired crystallization temperatures and levels of crystallinity. Thus, in the case of the packer 30, the barrier 42 could be constructed using a polymer 46 having a crystallization temperature which is somewhat less than the temperature to which it is expected to be exposed when appropriately positioned in a well. In this manner, the barrier 42 will become permeable to the swelling fluid 44 somewhat before the packer 30 is in its desired position in the well.

Preferably, the polymer 46 is at least 30% crystalline when it is desired for the polymer to be substantially impermeable to the swelling fluid 44. Examples of suitable polymers which may be used include low density polyethylene, high density polyethylene and polypropylene. Of course, combinations of different polymers may be used, if desired.

Figure 3:
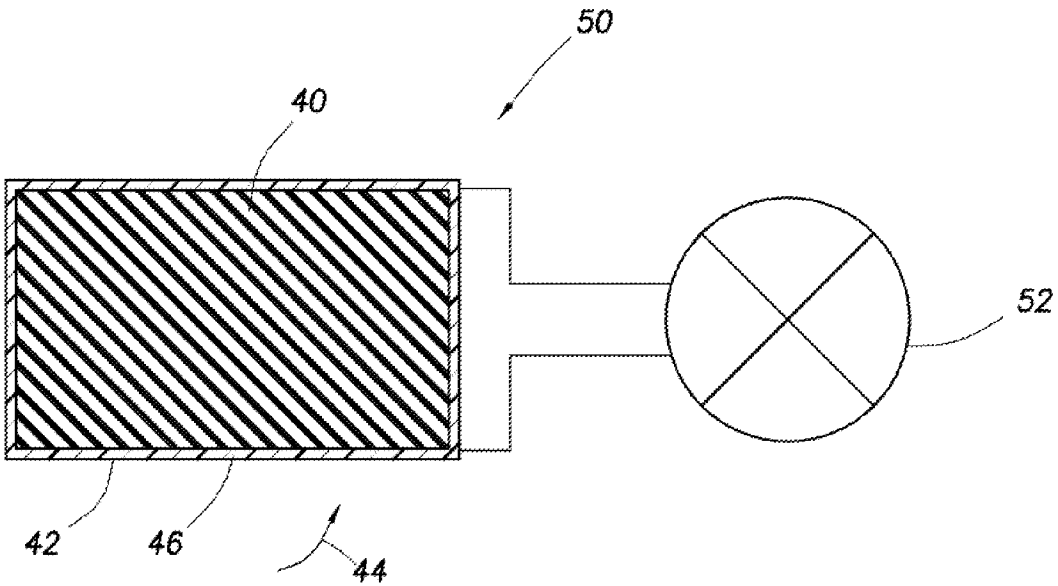
FIG. 3 is a representative cross-sectional view of a well tool actuator which can embody principles of this disclosure.

Referring additionally now to FIG. 3, a well tool actuator 50 which can embody principles of this disclosure is representatively illustrated. In this example, swelling of the material 40 is not necessarily used for creating a seal, but is instead used to actuate a well tool 52. The well tool 52 is depicted in FIG. 3 as comprising a valve, but other types of well tools (such as packers, samplers, formation testers, gravel packing/fracturing/stimulation equipment, sensors, inflow control devices, variable flow restrictors, etc.) may also be actuated using the actuator 50.

The barrier 42 isolates the material 40 from the swelling fluid 44, until a predetermined crystallization temperature of a polymer 46 of the barrier is reached. Once the crystallization temperature is reached, the barrier 42 becomes substantially permeable to the swelling fluid 44, thereby causing the material 40 to swell, which causes the actuator 50 to actuate the well tool 52. Thus, actuation of the well tool 52 can be delayed or prevented until the polymer 46 of the barrier 42 has been heated to its crystallization temperature.

In the packer 30 or actuator 50, the barrier 42 could be supplied as a coating, membrane, wrap, or any other structure. The barrier 42 may completely, or only partially, surround the swellable material 40.

It may now be fully appreciated that this disclosure provides several advancements to the art of using swellable materials in wells. Swelling of the material can be delayed or prevented until a certain predetermined temperature is reached, after which the material can swell in response to contact with a swelling fluid. The swelling fluid could be hydrocarbon gas, hydrocarbon liquid, water, etc.

In particular, the above disclosure provides to the art a swellable packer 30. The packer 30 can include a swellable material 40 which swells when contacted with a swelling fluid 44, and a barrier 42 comprising a relatively highly crystalline polymer 46 which is substantially impermeable to the swelling fluid 44.

The polymer 46 may be at least 30% crystalline.

The swelling fluid 44 may comprise hydrocarbon gas, whereby the polymer 46 is substantially impermeable to the hydrocarbon gas.

The polymer 46 may become substantially permeable to the swelling fluid 44 when the polymer 46 is heated to a crystallization temperature of the polymer 46.

The polymer 46 may comprise low density polyethylene, high density polyethylene and/or polypropylene.

Also described above is a method of controlling swelling of a swellable material 40 in a well. The method can include positioning the swellable material 40 and a barrier 42 in the well, the barrier preventing contact between the swellable material 40 and a swelling fluid 44 in the well, the barrier 42 comprising a polymer 46, and increasing a permeability of the barrier 42 to the swelling fluid 44 in response to the polymer 46 being heated to a crystallization temperature of the polymer 46.

The swellable material 40 may swell after the permeability of the barrier 42 to the swelling fluid 44 is increased.

An annulus 36 in the well may be sealed off as a result of swelling of the swellable material 40.

A well system 10 provided by this disclosure may comprise a swellable material 40 which swells in response to contact with a hydrocarbon gas, and a barrier 42 which comprises a crystalline polymer 46, the polymer 46 being substantially impermeable to the hydrocarbon gas. The polymer 46 initially prevents swelling of the swellable material 40, but the polymer 46 becomes increasingly permeable to the hydrocarbon gas when heated to a crystallization temperature of the polymer 46.

The swellable material 40 may swell in response to the polymer 46 being heated to the crystallization temperature.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A swellable packer, comprising:

a swellable material which swells when contacted with a swelling fluid; and a barrier comprising a relatively highly crystalline polymer which is substantially impermeable to the swelling fluid, wherein the polymer is at least 30% crystalline, and wherein the barrier becomes substantially permeable to the swelling fluid when the polymer is heated to a crystallization temperature of the polymer.

2. The swellable packer of claim 1, wherein the swelling fluid comprises hydrocarbon gas, and wherein the barrier is substantially impermeable to the hydrocarbon gas when the swellable packer is initially positioned in the well.

3. The swellable packer of claim 1, wherein the polymer comprises low density polyethylene.

4. The swellable packer of claim 1, wherein the polymer comprises high density polyethylene.

5. The swellable packer of claim 1, wherein the polymer comprises polypropylene.

6. A method of controlling swelling of a swellable material in a well, the method comprising:

disposing a swellable material on an exterior of a tubular;

completely surrounding a portion of the swellable material with a barrier, wherein the portion of the swellable material is that portion of the swellable material which does not directly contact the tubular;

positioning the swellable material and the barrier in the well, the barrier preventing contact between the swellable material and a swelling fluid in the well, the barrier comprising a polymer; and a permeability of the barrier to the swelling fluid being increased in response to the barrier being heated to a crystallization temperature of the polymer.

7. The method of claim 6, wherein the swellable material swells after the permeability of the barrier to the swelling fluid is increased.

8. The method of claim 7, wherein an annulus in the well is sealed off as a result of swelling of the swellable material.

9. The method of claim 6, wherein the polymer is at least 30% crystalline.

10. The method of claim 6, wherein the swelling fluid comprises hydrocarbon gas, and wherein the barrier is substantially impermeable to the hydrocarbon gas when the swellable material and the barrier are initially positioned in the well.

11. The method of claim 6, wherein the barrier becomes substantially permeable to the swelling fluid when the barrier is heated to a crystallization temperature of the polymer.

12. The method of claim 6, wherein the polymer comprises low density polyethylene.

13. The method of claim 6, wherein the polymer comprises high density polyethylene.

14. The method of claim 6, wherein the polymer comprises polypropylene.

15. A well system, comprising:

a swellable material which swells in response to contact with a hydrocarbon gas, the swellable material being disposed on an exterior of a tubular; and a barrier which comprises a crystalline polymer, the barrier being substantially impermeable to the hydrocarbon gas when the swellable material is initially positioned in the well, whereby the barrier initially prevents swelling of the swellable material, wherein the barrier becomes increasingly permeable to the hydrocarbon gas when heated to a crystallization temperature of the polymer, and wherein the barrier completely surrounds a portion of the swellable material which does not directly contact the tubular.

16. The well system of claim 15, wherein the swellable material swells in response to the polymer being heated to the crystallization temperature.

17. The well system of claim 15, wherein the polymer is at least 30% crystalline.

18. The well system of claim 15, wherein the polymer comprises low density polyethylene.

19. The well system of claim 15, wherein the polymer comprises high density polyethylene.

20. The well system of claim 15, wherein the polymer comprises polypropylene.

* * * * *